US005242288A

United States Patent [19]

Vincent

[11] Patent Number: 5,242,288

[45] Date of Patent: Sep. 7, 1993

[54] ROTARY ENGINE OR PUMP WITH A ROUND TOROIDAL CYLINDER AND PISTONS

[76] Inventor: Ogden W. Vincent, 2166 La Miel Way, Campbell, Calif. 95008

[21] Appl. No.: 96,377

[22] Filed: Sep. 14, 1987

[51] Int. Cl.[5] ..... F01C 1/40; F04C 2/40

[52] U.S. Cl. ..... 418/223; 418/244; 418/248; 418/249

[58] Field of Search ..... 418/161, 175, 176, 233, 418/244, 248, 249, 223

[56] References Cited

U.S. PATENT DOCUMENTS

| | | | |
|---|---|---|---|
| 669,502 | 3/1901 | Bonsteel | 418/176 |
| 1,122,403 | 12/1914 | Lexa | 418/249 |
| 1,378,897 | 5/1921 | Peterson | 418/249 |
| 2,097,714 | 11/1937 | Ayre | 418/233 |
| 4,076,471 | 2/1978 | McClure | 418/143 |

*Primary Examiner*—John J. Vrablik

[57] ABSTRACT

An engine or pump is described which has a round cylinder in cross section, the surface of the cylinder being a round toroidal tube in the rotary direction. The cylinder is made of two equal parts, one part fixed and one part rotating with each part meeting on a flat surface at a right angle to the driveshaft. Force exerted axially against the rotating cylinder part by a spring diaphram seals the cylinder where the two parts meet on the flat surface. The spring diaphram is pre-loaded by a thrust bearing in a pre-loading disk to apply force to the rotating part of the cylinder. Within the cylinder are one or more round toroidal section pistons that are attached to the rotating part of the cylinder by piston pins. A hinged internal cylinder abutment is actuated by the piston as the piston passes through the abutment section. Working fluid to the cylinder is controlled by an internal valve actuated by a cam-disk on the driveshaft.

17 Claims, 6 Drawing Sheets

ROTARY ENGINE OR PUMP WITH A ROUND TOROIDAL CYLINDER AND PISTONS

BACKGROUND OF THE INVENTION

Some early inventions of this type with a toroidal cylinder are listed as follows: U.S. Pat. Nos. 19,967; 259,964 (also 5,6,7); 627,832; 1,266,605; 1,921,662. These patents are mainly historical references of this type, showing that there was a great interest in this type of invention from the very beginning. In fact, there probably was more interest in the early days due to the fact that steam was used almost exclusively then.

Another class of invention related to this invention is the toroidal cylinder type used to make an internal combustion type engine. The following patents and the references therein are examples of this type: U.S. Pat. Nos. 2,284,186; 3,644,069; 3,500,798; 3,876,342; 3,767,331; 3,895,893; 4,072,447; 4,239,465; 3,899,269; 3,909,162; 4,035,111; 4,334,841; 4,174,930; 4,462,775. This type of invention is described as having two or four pistons that oscillate back and forth in various motions to create the motions necessary for internal combustion. These inventions are of interest because they have toroidal cylinders with pistons.

Next there is a class of invention with toroidal cylinders in which the abutments or pistons turn to pass each other. The following patents are examples of this type: U.S. Pat. Nos. 1,921,662; 3,521,979; 3,782,850; 3,867,075. These patents are of interest because they imploy toroidal cylinders. The pistons or abutments turn by various means which are not of interest here.

The invention class most related to this invention is U.S. Pat. No. 4,076,471 and the references cited therein. This patent has a toroidal cylinder and a piston that is a toroidal section like this invention. Also, this patent uses the piston to open the cylinder abutment. However, this patent uses a disk to hold the piston whereas the invention described by the inventor does not. Most inventions of this type have used a disk which rotates in the center of the cylinder. One of the advantages of the new invention described by the inventor is that the disk of older inventions has been eliminated as further described in detail.

Other inventions of interest here are U.S. Pat. Nos. 3,080,722; 3,810,724; 3,865,522; 4,462,775. This group of patents has movable abutments that are moved by a piston.

The search of the U.S. patents did not find an invention that is similar to the described invention herein. To the knowledge of the inventor the described invention appears to be unique and the first of its kind.

SUMMARY OF THE INVENTION

The described invention is a rotary pump or engine which uses a gas or fluid as the working substance. The cylinder wall is round in cross-section and is a toroid in its path around the driveshaft. Half of the cylinder wall is fixed and half rotates around the driveshaft. The two halves of the cylinder wall meet on a flat surface which is perpendicular to the driveshaft. The rotating half of the cylinder wall is held in alignment with the fixed half of the cylinder wall by a circular extension in the body of the fixed part. The rotating part of the cylinder rotates in the circular extension of the fixed part of the cylinder. The rotating part of the cylinder wall is held against the fixed part of the cylinder wall by a spring diaphram that is pre-loaded near the driveshaft by an adjustable disk with a thrust bearing in the center. Threaded rods going through the adjustable disk on the periphery are attached to the fixed part of the cylinder wall body. Adjustable nuts on the rods adjust the amount of pre-load the spring diaphram exerts on the rotating part of the cylinder wall and on the flat contact area of the two parts of the cylinder wall.

There is one or more pistons inside the cylinder, each piston being connected to the rotating part of the cylinder. Working fluid bears against a piston. The cross section of a piston is a circle, but the piston is also toroidal in the direction of rotation to have close contact with the cylinder wall. The pistons actuate cylinder abutments which are also toroidal sections and have close contact to the cylinder wall. A cylinder abutment turns on a hinge into an abutment chamber in the fixed cylinder body as a piston goes by. Then the abutment returns to position by a spring. A fluid metering valve is in a valve chamber near the abutment chamber and is operated by a cam-track on a cam-disk that rotates around the driveshaft.

DETAILED DESCRIPTION

Figure 1:
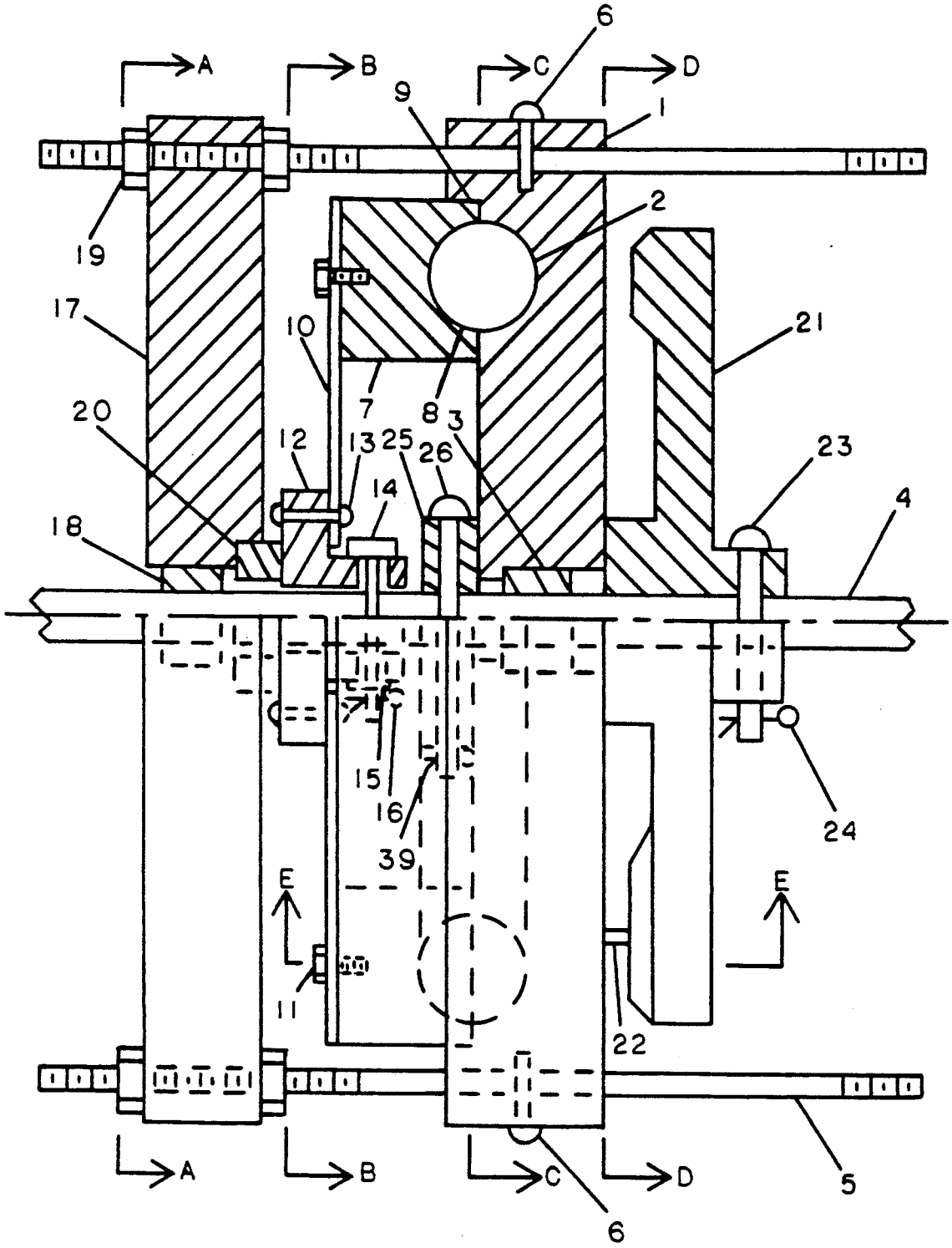
FIG. 1 is a side view of the engine or pump, the top half showing a cross section view.
Figure 2:
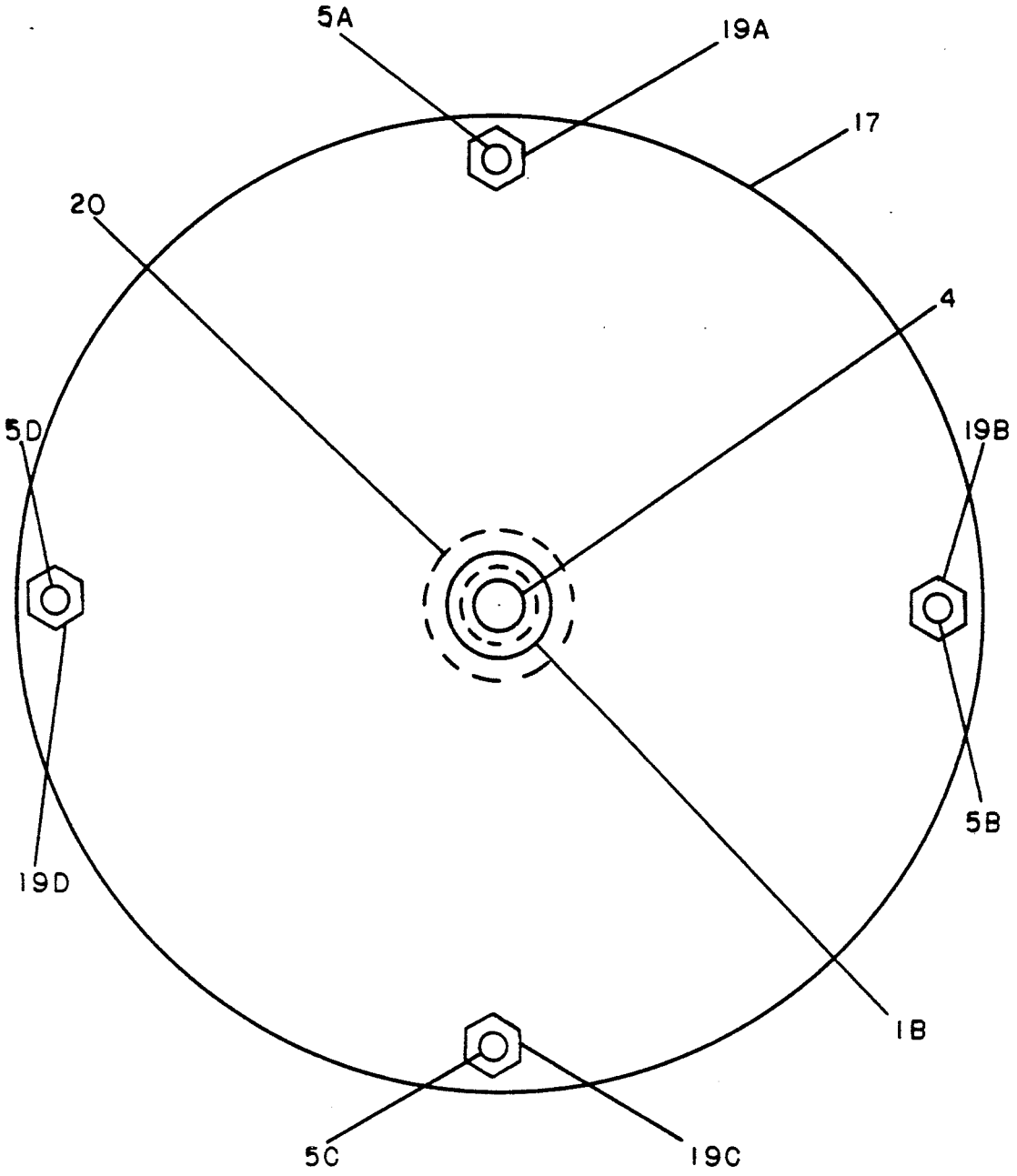
FIG. 2 is a front view A—A showing the pre-loading disk, driveshaft bearing, rods, rod nuts, and thrust bearing.
Figure 3:
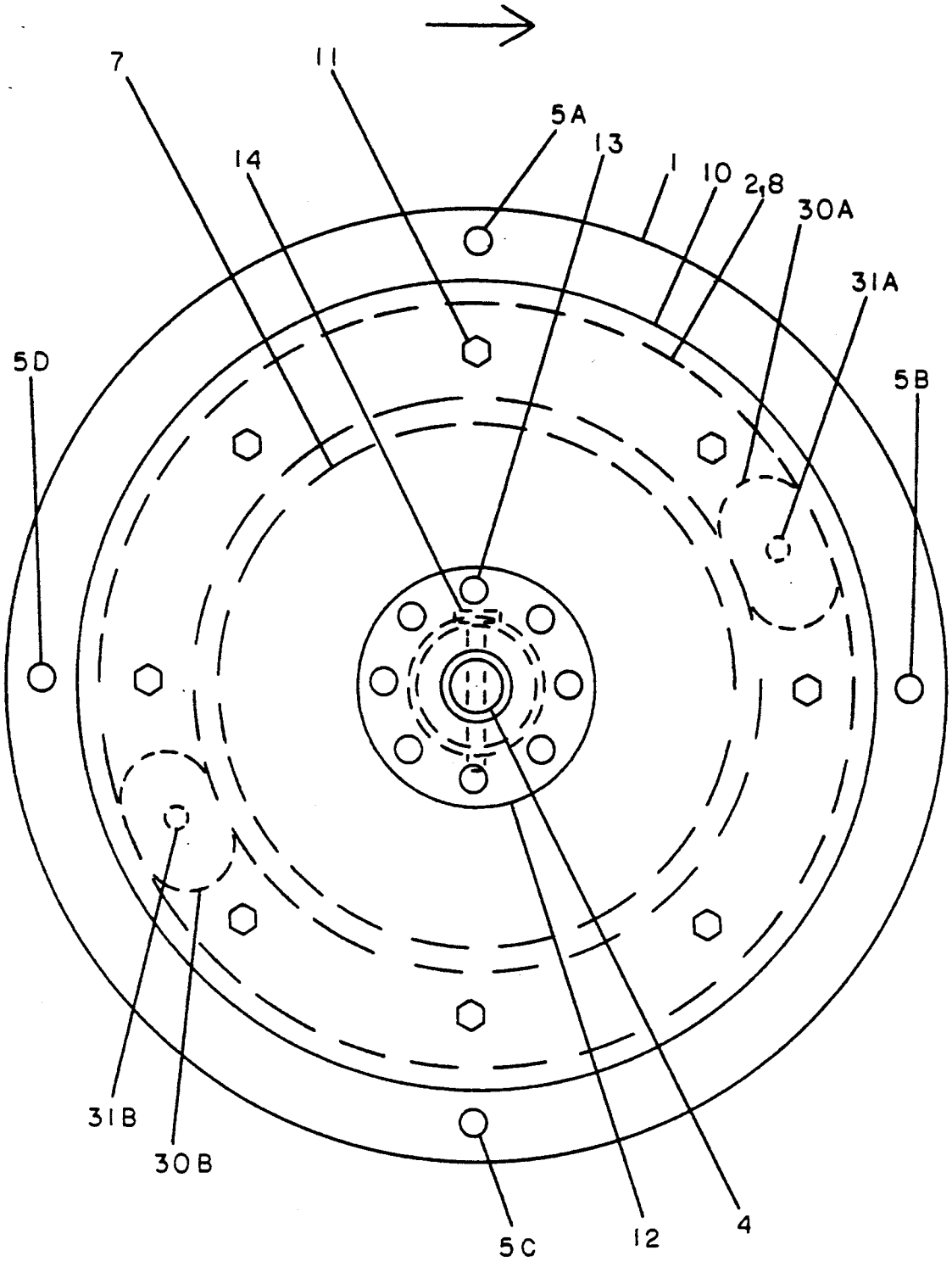
FIG. 3 is a front view B—B showing hub, spring diaphram, rotating cylinder part, fixed cylinder part, rods, and pistons.
Figure 4:
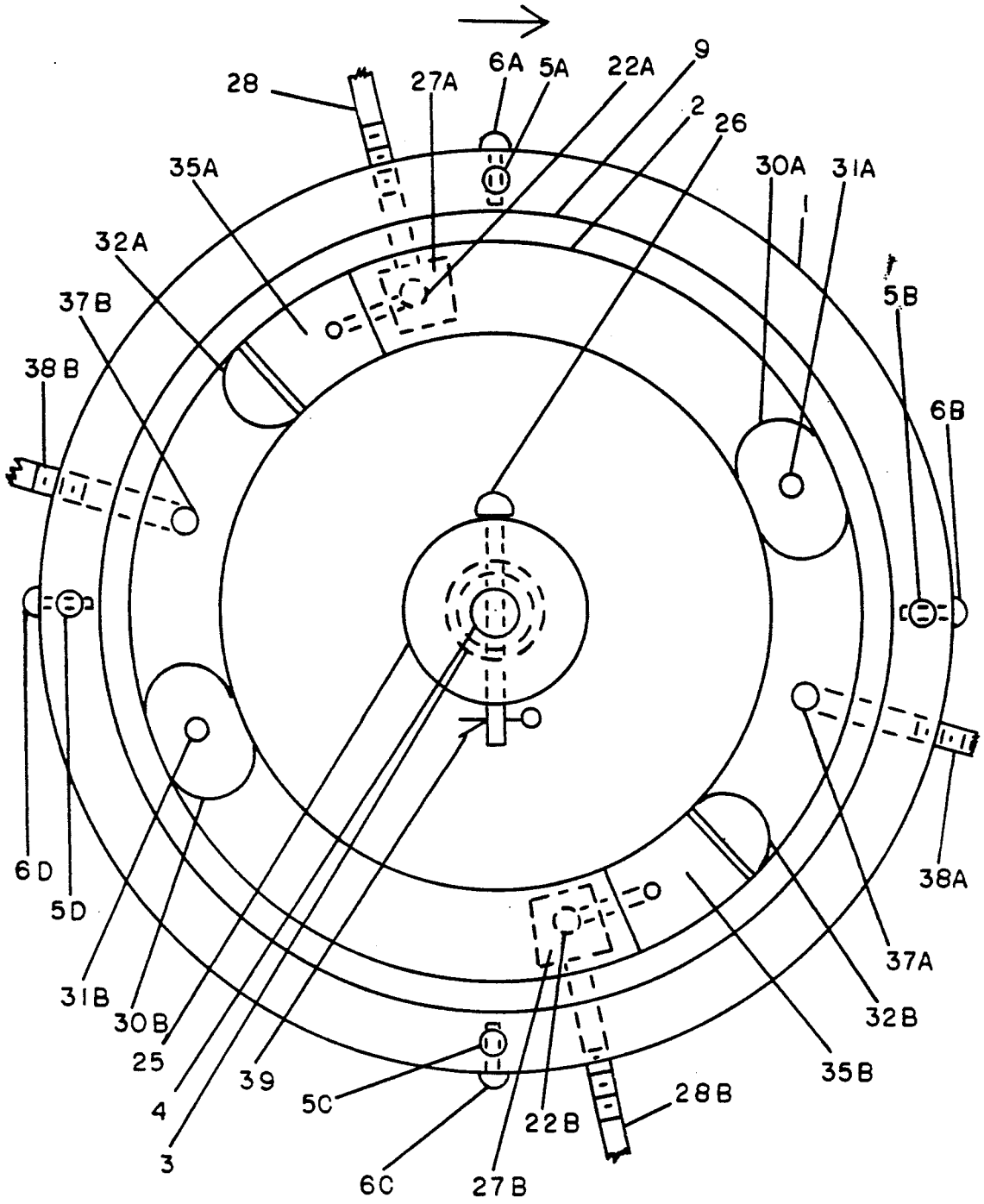
FIG. 4 is a front view C—C showing fixed cylinder part, pistons, abutments, abutment chambers, fluid valves, fluid pipes, driveshaft bearing, valve chambers, locating ring, and rods.
Figure 5:
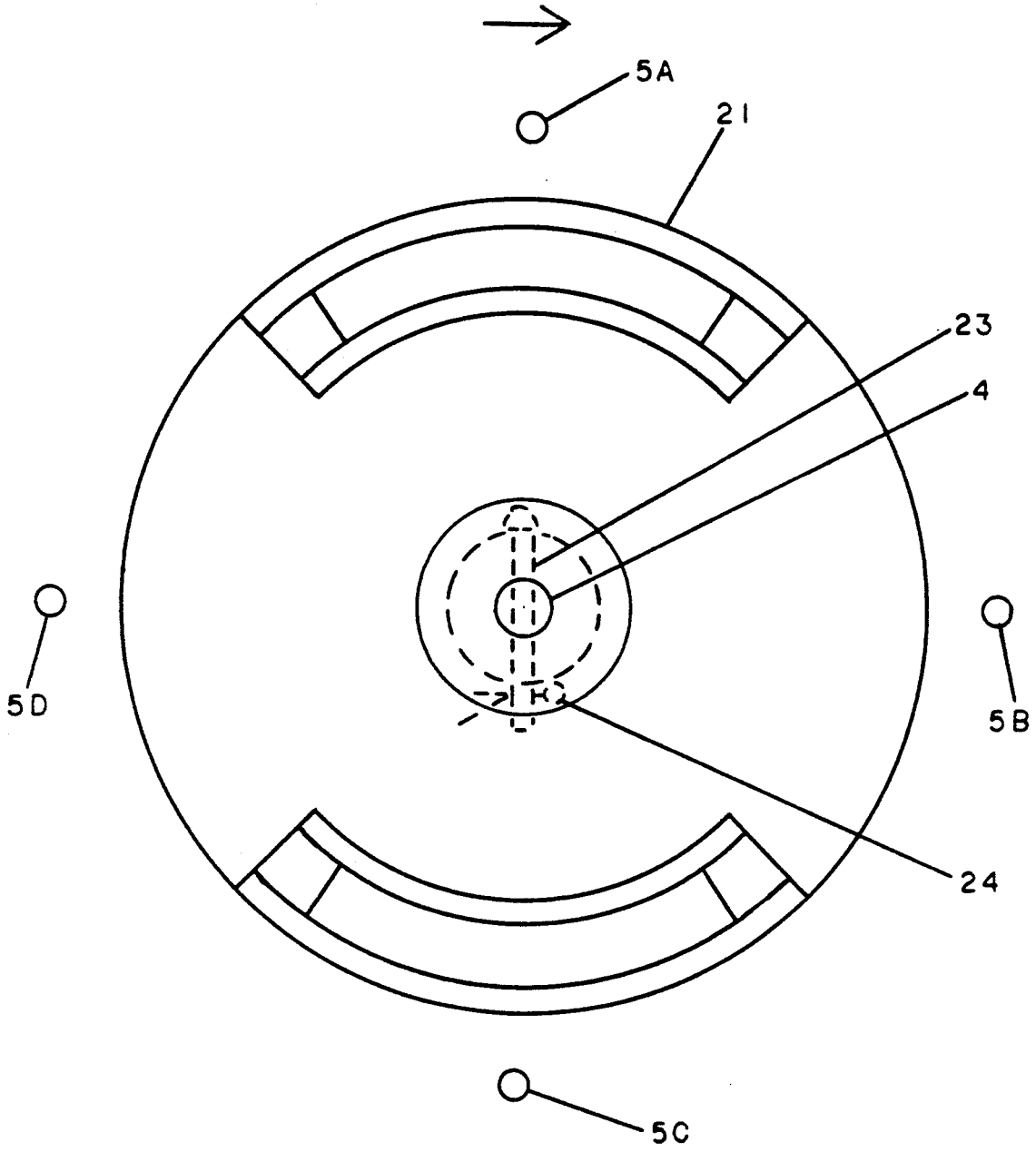
FIG. 5 is a front view D—D showing the cam-disk.

Part 1 is a fixed body for one-half of a cylinder wall part 2, which is one-half of a circle in cross section as shown in FIG. 1 and is toroidal about the direction of rotation as shown in FIG. 4. Part 3 is a bearing such as a roller bearing which fits in part 1. Part 4 is a round driveshaft which revolves in bearing part 3. Four round rods each part 5 pass through holes in the periphery of part 1, and each rod is attached to part 1 by a pin part 6. Both ends of rod part 5 are threaded, the threads being used for mounting purposes, pre-load adjusting, etc.

Part 7 is the rotating part for one-half of the cylinder wall part 8, which is one-half of a circle in cross section as shown in FIG. 1 and is toroidal about the direction of rotation as shown in FIG. 4. Part 7 revolves in part 1 because part 7 is constrained to do so by a round extension of part 1 which is part 9. As shown in FIG. 4 part 9 is a circle about the axis and part 7 fits the same circle. Thus, cylinder wall part 2 joins cylinder wall part 8 to form a complete circle where they meet due to extension part 9. The vertical surfaces where parts 1 and 7 meet are perfectly flat so the they form a seal when properly lubricated.

Part 10 is a spring diaphram which is joined to part 7 by eight bolts each part 11. Part 10 is riveted at the center to hub part 12 by eight rivets each part 13. Shaft part 4 goes through the middle of hub part 12 but does not touch it because there is a gap inbetween for movement both vertically and horizontally. Pin part 14 goes through a slot in part 12, the length of the slot allowing movement of part 12 along the direction of the shaft. Pin part 14 is for the purpose of connecting hub part 12 to the shaft part 4. Thus, rotating part 7 drives the shaft part 4 via parts 10, 11, 12, 13, and 14. The purpose of spring diaphram part 10 is to apply a predetermined amount of force on part 7 so as to form a flat seal against part 1 when the hub part 12 is pushed toward part 1. Washer part 15 and cotter pin part 16 keep pin part 14 from coming out of part 12.

Part 17 is a pre-loading disk which has a bearing part 18 in the center through which shaft part 4 goes. Bearing part 18 could be a roller bearing which holds shaft part 4 steady as it rotates. Four rods each part 5 go through holes on the outside of disk part 17 and have eight nuts each part 19 on threaded portions which are tightened equally by a torque wrench to apply a force against a thrust bearing part 20. The purpose of leading disk part 17 is to apply force in the direction of the shaft equally to hub 12 via thrust bearing part 20. Thrust bearing part 20 is in the center of pre-loading disk part 17 and pushes against hub part 12 equally. Thrust bearing part 20 could be a roller bearing.

Figure 6:
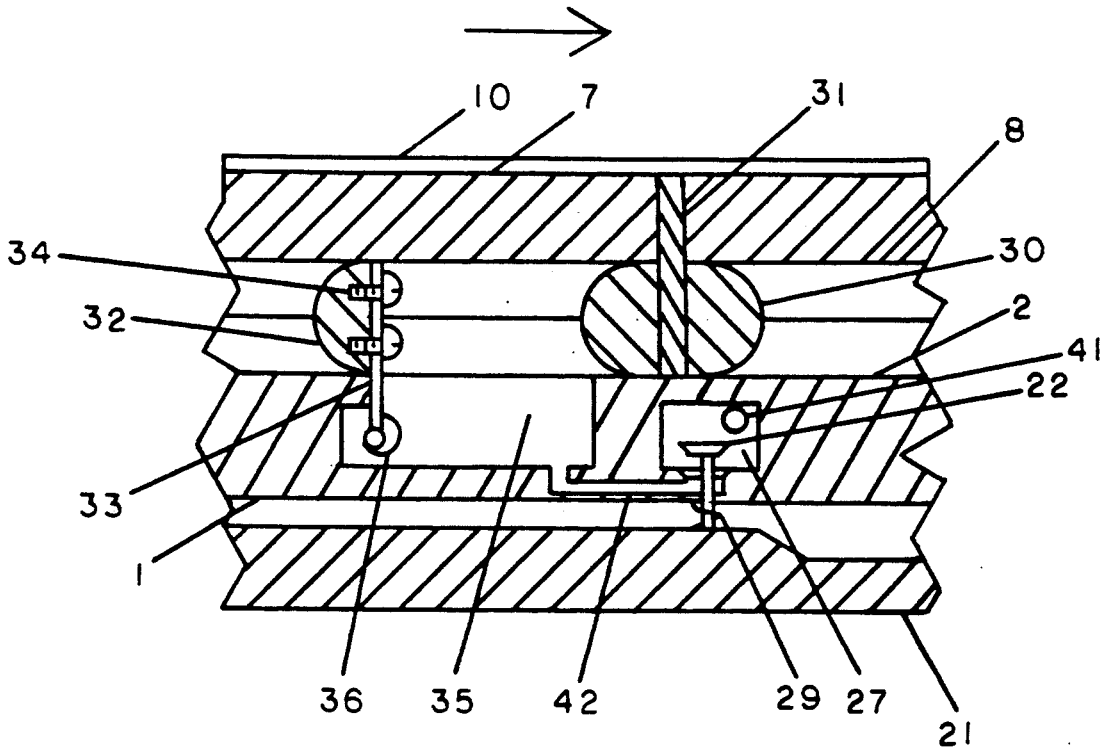
FIG. 6 is an engine cross section of the cylinder view E—E showing the fixed cylinder part, rotating cylinder part, spring diaphram, piston, abutment with chamber, fluid valve in chamber, and cam-disk.

Part 21 is a cam-disk which is used to raise fluid metering valves each part 27. Shaft part 4 goes through a hole in the center of cam-disk part 21 which is made to rotate with the shaft part 4 by pin part 23. Cotter pin part 24 keeps pin part 23 from coming out of the hub of part 21. Part 25 is a locating disk which is located at a predetermined distance from part 21 along shaft part 4 by the hole location for pin part 26. Cotter pin part 39 keeps part 26 in place. Thus, parts 21 and 25 both rotate around part 1 while being held close to part 1, thereby holding the shaft part 4 from moving longtitudinally. Each valve part 22 is located in a valve chamber part 27 in part 1 as shown in FIG. 4 and FIG. 6. Working fluid is brought to each valve chamber part 27 by each pipe part 28 and by a tube between the pipe and chamber in part 1. The valve each part 22 is held closed by a spring each part 29 and by fluid pressure when the track on cam-disk part 21 is not pushing it open.

Part 30 is a piston which is round in cross section and which is part of a toroid, exactly fitting the cylinder formed by wall surfaces part 2 and part 8. Each end of part 30 is spherical in shape. Parts 30A and 30B are spaced 180 degrees apart to counterbalance weights and applied forces. A large pin part 31 attaches piston part 30 to rotating cylinder part 7, the fit between parts 30 and 31 being a sliding fit. Part 32 is an abutment which is round to exactly fit cylinder surfaces parts 2 and 8 and which is also spherical on the end as shown in FIG. 6. Abutment part 32 is attached to hinge part 33 by screws each part 34. Hinge part 33 is attached to part 1 in an abutment chamber part 35. Abutment part 32 is held closed by a spring part 36 on hinge part 33 and by fluid pressure from valve 22. When piston part 30 rotates into abutment part 32, the abutment opens by turning on hinge part 33 into abutment chamber part 35, during this time valve part 22 being closed. As piston part 30 rotates past abutment chamber part 35, abutment part 32 swings closed and the track on cam-disk part 21 pushes valve part 22 open, thereby allowing working fluid to enter abutment chamber part 35 by a tube part 42, putting pressure on piston 30, and causing cylinder part 7 to rotate in the direction of the arrows. When piston part 30 rotates on past abutment chamber part 35 and approaches exhaust tube part 37, fluid ahead of part 30 is pushed out exhaust tube part 37. As part 30 approaches part 37, the track on cam-disk part 21 closes valve 22. When piston part 30 has rotated past exhaust tube part 37, the working fluid behind the piston exhausts out the exhaust tube into exhaust pipe 38. As piston part 30 rotates more and moves to abutment part 32, there is a build up of pressure infront of the piston, which helps open the abutment part 32, and then mechanical force from the piston part 30 pushes the abutment part 32 open.

Figure 7:
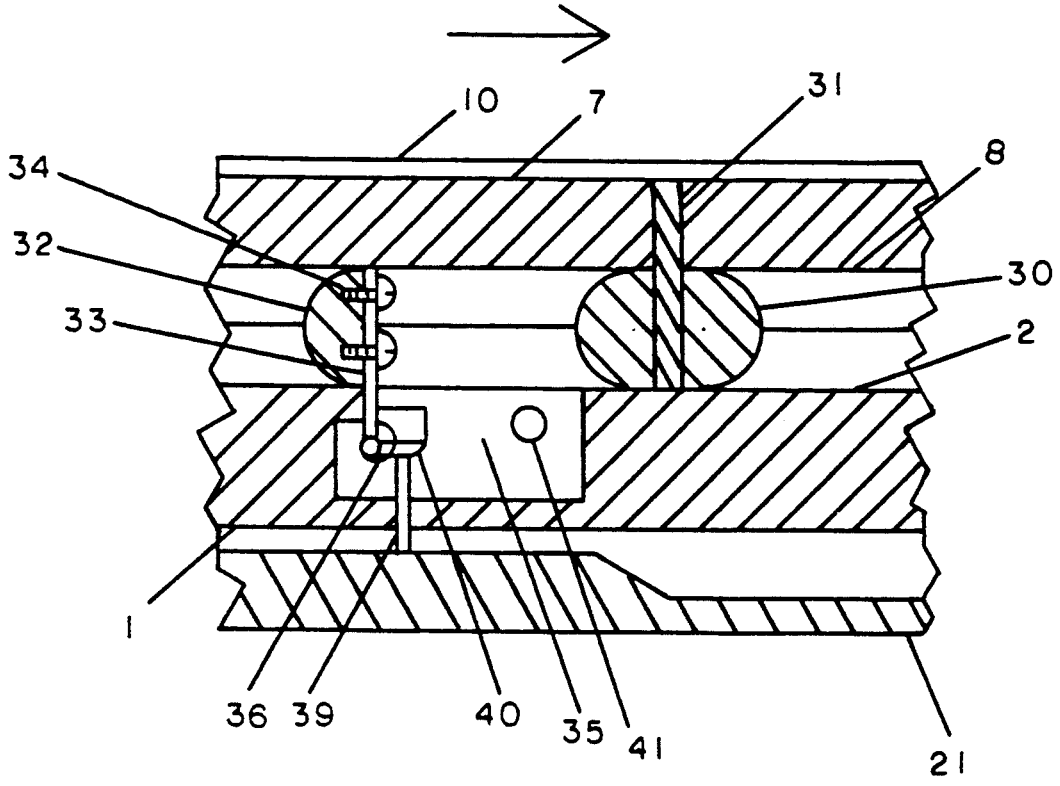
FIG. 7 is a pump cross section of the cylinder view E—E showing the fixed cylinder part, rotating cylinder part, spring diaphram, piston, abutment with chamber, and push rod.

What has been described in previous paragraphs is the operation of the invention as an engine. All the parts described fit equally well for a pump with the exception that parts 22, 27, and 29 are not used, the input valve being replaced by a back-check valve on input pipe part 28 which is not shown. FIG. 7 shows the section view E—E for a pump. Hinged abutment parts 32 and 33 are forced closed and held closed by a push rod part 39 in abutment chamber 35 when piston part 30 has rotated past abutment chamber part 35. Push rod part 39 rides on a cam-track of cam-disk part 21, pushing on a lever arm part 40 attached to hinge part 33, thereby forcing and holding abutment part 32 in the cylinder. Working fluid enters the cylinder at input tube part 41 from input pipe 28 due to the suction created by the piston part 30 which is forced to rotate by force exerted on the shaft part 4. Piston part 30 sucks working fluid in the cylinder behind it and forces working fluid out ahead of it, the working fluid leaving by exhaust tube part 37 and exhaust pipe part 38. A back-check valve located in pipe part 38 prevents working fluid from flowing back into the cylinder, this check valve not being shown. As piston part 30 rotates by exhaust tube part 37, push rod part 39 is released from the cam-track of cam-disk part 21, the pressure of the working fluid ahead of piston part 30 making abutment parts 32 and 33 open until piston part 30 contact forces them open the rest of the way.

It is to be understood that the embodiment described herein is merely illustrative of the principles of the invention. Various modifications thereto may be effected by persons skilled in the art without departing from the spirit and scope of the invention.

What is claimed is:

1. A rotary engine comprising:

(a) a horizontal drive shaft for conveying power, (b) a vertical toroidal cylinder being made of a fixed part and a rotating part, said fixed part and said rotating part meeting on a flat vertical surface, said rotating part rotating in a circular extension of said fixed part, a bearing in the center of said fixed part holding said shaft, (c) a spring means being attached to said rotating part and to said shaft which goes freely through the center of said spring means, said spring means exerting a pre-load force on said rotating part when moved freely a predetermined horizontal distance, (d) a vertical pre-loading means being adjusted horizontally to contact said spring means for exerting a pre-load on said spring means, said pre-loading means moving horizontally along said shaft which is centrally located, (e) a vertical cam-disk means being attached to said shaft in the center, said cam-disk means having at least one cam-track for operating an input valve, (f) a housing means connecting said fixed part to said pre-loading means, (g) at least one piston in said cylinder having the shape of said cylinder, said piston being attached to said rotating part, (h) at least one abutment means in said cylinder having an abutment with the shape of said cylinder, said abutment moving out of said cylinder by force exerted by said piston, (i) at least one input valve means being in said fixed part to meter input working fluid, said valve means operating by a means riding on said cam-track, said valve means being connected to said cylinder by a tube and to an input pipe by a tube, and (j) at least one exhaust tube in said fixed part being connected to said cylinder and to an exhaust pipe for exhaust of said fluid.

2. The rotary engine of claim 1 including said fixed part containing one-half the surface of said cylinder which is a circular toroidal cylinder and said rotating part containing one-half the surface of said cylinder.

3. The rotary engine of claim 2 including said spring means having a spring attached to said rotating part and to a hub, said shaft going through a central hole in said hub without touching, said hub being free to move horizontally a predetermined distance, and said hub being connected to said shaft.

4. The rotary engine of claim 3 including said pre-loading means being a disk with a driveshaft bearing in the center and with a central thrust bearing in the back, said thrust bearing contacting the front of said hub but not said shaft.

5. The rotary engine of claim 4 including said cam-disk means having a cam-disk which is attached to said shaft and which is in contact with the back of said fixed part, a locating ring of said cam-disk means being attached to said shaft and held in contact with the front of said fixed part.

6. The rotary engine of claim 5 including said housing means having at least two rods, each rod being held in a horizontal peripheral hole in said fixed part, each said rod passing through a peripheral horizontal aligning hole in said pre-loading disk where pre-load adjusting nuts are used on threaded parts of said rods.

7. The rotary engine of claim 6 including said abutment means having said abutment with a hinge and a return spring, an abutment chamber of said abutment means being in said fixed part where said spring loaded hinge is attached.

8. The rotary engine of claim 7 including said input valve means having an input valve chamber with said input valve which has a return spring.

9. A rotary pump comprising:

(a) a horizontal driveshaft being driven by an external power source, (b) a vertical toroidal cylinder being made of a fixed part and a rotating part, said fixed part and said rotating part meeting on a flat vertical surface, said rotating part rotating in a circular extension of said fixed part, a bearing in the center of said fixed part holding said shaft, (c) a spring means being attached to said rotating part and to said shaft which goes freely through the center of said spring means, said spring means exerting a pre-load force on said rotating part when moved freely a predetermined horizontal distance, (d) a vertical pre-loading means being adjusted horizontally to contact said spring means for exerting a pre-load on said spring means, said pre-loading means moving horizontally along said shaft which is centrally located, (e) a vertical cam-disk means being attached to said shaft in the center, said cam disk means having at least one cam-track for operating a push rod, (f) a housing means connecting said fixed part to said pre-loading means, (g) at least one piston in said cylinder having the shape of said cylinder, said piston being attached to said rotating part, (h) at least one abutment means in said cylinder having an abutment with the shape of said cylinder, said abutment moving out of said cylinder by force exerted by said piston, said abutment closing into said cylinder by force of a push rod, (i) at least one exhaust tube in said fixed part being connected to said cylinder and to an exhaust pipe for exhaust of said fluid.

10. The rotary pump of claim 9 including said fixed part containing one-half the surface of said cylinder which is a circular toroidal cylinder and said rotating part containing one-half the surface of said cylinder.

11. The rotary pump of claim 10 including said spring means having a spring attached to said rotating part and to a hub, said shaft going through a central hole in said hub without touching, said hub being free to move horizontally a predetermined distance, and said hub being connected to said shaft.

12. The rotary pump of claim 11 including said pre-loading means being a disk with a drive shaft bearing in the center and with a central thrust bearing in the back, said thrust bearing contacting the front of said hub but not said shaft.

13. The rotary pump of claim 12 including said cam-disk means having a cam-disk which is attached to said shaft and which is in contact with the back of said fixed part, a locating ring of said cam-disk means being attached to said shaft and held in contact with the front of said fixed part.

14. The rotary pump of claim 13 including said housing means having at least two rods, each said rod being held in a horizontal peripheral hole in said fixed part, each said rod passing through a peripheral horizontal aligning hole in said pre-loading disk where pre-load adjusting nuts are used on threaded parts of said rods.

15. The rotary pump of claim 14 including said abutment means having said abutment with a hinge and return spring, an abutment chamber of said abutment means being in said fixed part where said spring loaded hinge is attached, an arm of said hinge being pushed by said push rod.

16. A rotary engine comprising:

(a) a horizontal circular driveshaft for conveying power, (b) a vertical circular toroidal cylinder being made of a fixed part which contains one-half of the surface of said cylinder and of a rotating part which contains one-half of the surface of said cylinder, said fixed part and said rotating part meeting on a flat vertical surface, said rotating part rotating in a circular extension of said fixed part, a bearing in the center of said fixed part holding said shaft, at least two horizontal rod holes being located on the periphery of said fixed part, (c) a spring means being attached to said rotating part and to a hub, said shaft going through a central hole in said hub, said hub being free to move both horizontally and vertically predetermined distances, a connecting pin being located in a hole in said hub and a hole in said shaft, (d) a vertical pre-loading disk having a driveshaft bearing in the center, at least two horizontal rod holes being located on the periphery of said pre-loading disk, a thrust bearing being located centrally in the back of said pre-loading disk, said thrust bearing contacting the front of said hub but not said shaft, (e) a vertical round cam-disk being attached to said shaft, said shaft going through a hole in the center of said cam-disk, the front shoulder of said cam-disk being held in contact with the back of said fixed part by a locating ring attached to said shaft, said locating ring contacting the front of said fixed part, at least one cam-track having raised portions on said cam-disk for operating an extension of an input valve, (f) at least two horizontal round rods being threaded on each end, each rod passing through a rod hole in said fixed part and a rod hole in said pre-loading disk, each rod being held in said fixed part, each rod having at least one pre-load adjusting nut, (g) at least one piston with the shape of said cylinder being located in said cylinder, said piston being attached to said rotating part, (h) at least one hinged cylinder abutment in said cylinder having the shape of said cylinder, said abutment turning on a hinge into an abutment chamber in said fixed part by contact force of said piston, said abutment returning to said cylinder by a spring after said piston rotates further past, (i) at least one said input valve being in an input valve chamber in said fixed part for input metering of a working fluid, said valve connecting with said abutment chamber by a tube in said fixed part, said valve chamber connecting to an input pipe by a tube in said fixed part, said valve closing by a spring, and (j) at least one exhaust tube being in said fixed part for the exhaust of said fluid when said piston rotates past said exhaust tube, said exhaust tube being connected to said cylinder and to an exhaust pipe.

17. A rotary pump comprising:

(a) a horizontal circular drive shaft being driven by an external power source, (b) a vertical circular toroidal cylinder being made of a fixed part which contains one-half of the surface of said cylinder and of a rotating part which contains one-half of the surface of said cylinder, said fixed part and said rotating part meeting on a flat vertical surface, said rotating part rotating in a circular extension of said fixed part, a bearing in the center of said fixed part holding said shaft, at least two horizontal rod holes being located on the periphery of said fixed part, (c) a spring means being attached to said rotating part and to a hub, said shaft going through a central hole in said hub, said hub being free to move both horizontally and vertically predetermined distances, a connecting pin being located in a hole in said hub and a hole in said shaft, (d) a vertical pre-loading disk having a driveshaft bearing in the center, at least two horizontal rod holes being located on the periphery of said pre-loading disk, a thrust bearing being located centrally in the back of said pre-loading disk, said thrust bearing contacting the front of said hub but not said shaft, (e) a vertical round cam-disk being attached to said shaft, said shaft going through a hole in the center of said cam-disk, the front shoulder of said cam-disk being held in contact with the back of said fixed part by a locating ring attached to said shaft, said locating ring contacting the front of said fixed part, at least one cam-track having raised portions on said cam-disk for operating a push rod, (f) at least two horizontal round rods being threaded on each end, each rod passing through a rod hole in said fixed part and a rod hole in said pre-loading disk, each rod being held in said fixed part, each rod having at least one pre-load adjusting nut, (g) at least one piston with the shape of said cylinder being located in said cylinder, said piston being attached to said rotating part, (h) at least one hinged cylinder abutment in said cylinder having the shape of said cylinder, said abutment turning on a hinge into an abutment chamber in said fixed part by contact force of said piston, said abutment returning to said cylinder by a spring and by force of said push rod pushing on an arm connected to said hinge after said piston rotates further past, (i) at least one said push rod being in said abutment chamber, an input tube in said fixed part being connected to said abutment chamber and to an input pipe for entrance of a working fluid, and (j) at least one exhaust tube being in said fixed part for the exhaust of said fluid, said exhaust tube being connected to said cylinder and to an exhaust pipe.

* * * * *